US010389059B1

(12) United States Patent
Li et al.

(10) Patent No.: US 10,389,059 B1
(45) Date of Patent: Aug. 20, 2019

(54) ALL-IN-ONE STEREO SOCKET

(71) Applicant: Shenzhen Lianxunfa Technology Co., LTD., Guangdong (CN)

(72) Inventors: Zezhi Li, Guangdong (CN); Yiguang Qin, Guangdong (CN)

( * ) Notice: Subject to any disclaimer, the term of this patent is extended or adjusted under 35 U.S.C. 154(b) by 0 days.

(21) Appl. No.: 16/038,193

(22) Filed: Jul. 18, 2018

(30) Foreign Application Priority Data

Jun. 1, 2018 (CN) ..... 2018 2 0845043 U

(51) Int. Cl.
*H01R 13/514* (2006.01)
*H01R 9/24* (2006.01)

(52) U.S. Cl.
CPC ..... *H01R 13/514* (2013.01); *H01R 9/2408* (2013.01)

(58) Field of Classification Search
CPC ..... H01R 9/2408; H01R 13/4536; H01R 13/514; H01R 13/521; H01R 13/7032; H01R 13/707; H01R 13/713; H01R 25/006; H01R 24/78; H01R 27/00; H01R 31/06
USPC ..... 439/135–150, 650–652, 701
See application file for complete search history.

(56) References Cited

U.S. PATENT DOCUMENTS 3,034,084 A * 5/1962 Schmier ..... H01R 31/02 439/105
6,875,051 B2 * 4/2005 Pizak ..... H01R 25/003 439/501
6,929,514 B1 * 8/2005 Chuang ..... H01R 31/02 439/108
7,112,097 B1 * 9/2006 Lam ..... H01R 25/003 439/654
7,371,121 B1 * 5/2008 Lee ..... H01R 13/7175 439/650
7,914,307 B1 * 3/2011 Yang ..... H01R 13/4534 439/137
8,147,260 B2 * 4/2012 Huang ..... H01R 13/4534 439/140
8,851,909 B2 * 10/2014 Shammoh ..... H01R 25/006 439/134

(Continued)

FOREIGN PATENT DOCUMENTS

DE 2434578 A1 * 1/1976 ..... H01R 13/4534

*Primary Examiner* — Edwin A. Leon
*Assistant Examiner* — Oscar C Jimenez
(74) *Attorney, Agent, or Firm* — Prakash Nama; Global IP Services, PLLC

(57) ABSTRACT

The invention discloses an all-in-one stereo socket, comprising an housing, wherein the housing is in the shape of a cube with adjacent faces transitioned spherically; the housing has a top face provided with a power switch and a USB jack, three continuous side faces provided with three-prong outlet modules each having an outlet, another side face provided with a power line, and a bottom face acting as a support face; the housing is internally provided with a circuit board and a support frame assembly; the circuit board is provided with a USB plugging terminal corresponding to the USB jack; the support frame assembly is internally provided with live-line conductive terminals, null-line conductive terminals and grounding conductive terminals, which are arranged corresponding to respective outlets; and the back face of each three-prong outlet module is provided with a protective door device fixed to the support frame assembly.

2 Claims, 4 Drawing Sheets

(56) References Cited

U.S. PATENT DOCUMENTS

| | | | | |
|---|---|---|---|---|
| 8,894,436 | B2 * | 11/2014 | Su | H01R 12/7088 439/501 |
| 9,356,380 | B1 * | 5/2016 | Ma | H01R 31/065 |
| 9,438,070 | B2 * | 9/2016 | Byrne | H02J 5/005 |
| 9,543,770 | B1 * | 1/2017 | O'Keefe | H01R 31/02 |
| 9,635,773 | B1 * | 4/2017 | Marshall | H01R 13/70 |
| 2006/0216986 | A1 * | 9/2006 | Amiri-Hezaveh | H01R 25/00 439/535 |
| 2009/0156061 | A1 * | 6/2009 | Bernstein | H01R 13/652 439/652 |
| 2009/0311892 | A1 * | 12/2009 | Weeks | H01R 13/4534 439/137 |
| 2010/0167580 | A1 * | 7/2010 | Lee | H01R 13/506 439/490 |
| 2012/0045926 | A1 * | 2/2012 | Lee | H01R 13/6691 439/488 |
| 2012/0139745 | A1 * | 6/2012 | Makwinski | G06F 1/26 340/815.45 |
| 2013/0189864 | A1 * | 7/2013 | Chen | H01R 13/453 439/136 |
| 2014/0030898 | A1 * | 1/2014 | Baldwin | H01R 13/4534 439/140 |
| 2014/0104805 | A1 * | 4/2014 | Row | H01R 13/516 361/807 |
| 2015/0207271 | A1 * | 7/2015 | Si | H01R 24/78 439/92 |
| 2016/0380378 | A1 * | 12/2016 | Makwinski | G06F 1/26 439/131 |
| 2018/0323558 | A1 * | 11/2018 | Zhang | H01R 13/46 |

* cited by examiner

ALL-IN-ONE STEREO SOCKET

BACKGROUND OF THE INVENTION

The invention relates to the field of household appliances, and in particular to an all-in-one stereo socket.

At present, household appliances have become an indispensable part of our lives. The household appliances are generally used by means of a socket, and thus, the frequency of using sockets is getting higher and higher. To make full use of space, there is an all-in-one stereo socket emerging at present, which can be plugged with plugs on all sides and thus is easy to use. However, the existing all-in-one stereo socket is currently complex in structure and high in manufacturing cost at.

BRIEF SUMMARY OF THE INVENTION

The invention provides an all-in-one stereo socket, which is safe and reliable with simple structure and convenience in use.

To solve the above technical problem, the invention employs the following technical solution:

an all-in-one stereo socket comprises a housing; the housing is in the shape of a cube provided with six faces, with adjacent faces transitioned spherically; the housing has a top face provided with a power switch and a USB jack, three continuous side faces provided with three-prong outlet modules each having an outlet, another side face provided with a power line, and a bottom face acting as a support face; the housing is internally provided with a circuit board and a support frame assembly; the circuit board is provided with a USB plugging terminal corresponding to the USB jack; the support frame assembly is internally provided with live-line conductive terminals, null-line conductive terminals and grounding conductive terminals, which are arranged corresponding to respective outlets; and the back face of each three-prong outlet module is provided with a protective door device fixed to the support frame assembly.

The support frame assembly is internally provided with live-line conductive strips, null-line conductive strips and grounding conductive strips; the respective live-line conductive terminals and live-line conductive strips are in an all-in-one structure; the respective null-line conductive terminals and null-line conductive strips are in an all-in-one structure; and the respective grounding conductive terminals and grounding conductive strips are in an all-in-one structure.

The support frame assembly comprises a first support block, a second support block, a third support block and a fourth support block, which are arranged from top to bottom in turn; the first support block and the fourth support block are fixed in a buckling way; and the second support block and the third support block are clamped and fixed between the first support block and the fourth support block.

The live-line conductive strips are fixed between the first support block and the second support block; the null-line conductive strips are fixed between the third support block and the fourth support block; and the grounding conductive strips are fixed between the second support block and the third support block.

The housing is internally provided with an overload protector connected with the power line.

The protective door device comprises a fixed cover, which is provided with through holes corresponding to the live-line conductive terminals and the null-line conductive terminals respectively; the fixed cover is internally provided with a movable door, which is in the shape of a framework with two ends provided with bevel sections arranged corresponding to the through holes; a spring is disposed between the movable door and the fixed cover to press against the movable door to close the through holes; two sides of the fixed cover are provided with elongated through slots respectively; and the movable door is provided with projecting posts, which correspond to the through slots and are snapped into the through slots.

The fixed cover is internally provided with a first limiting projection and a second limiting projection for limiting the horizontal sliding of the movable door after the movable door is rotated; and the first limiting projection abuts against the inner edge of the framework of the movable door when the movable door rotates towards one direction, and the second limiting projection abuts against one end face of the movable door when the movable door rotates towards the other direction.

The fixed cover is internally provided with a fixed block, on which a first mounting post is disposed, the movable door is provided with a second mounting post, and two ends of the spring are fixed to the first and second mounting posts respectively.

The invention can be plugged with plugs at multiple sides to make effective use of the space and thus is convenient to use. With each of the provided live-line conductive terminals, null-line conductive terminals and grounding conductive terminals located within the support frame, the invention is simple in structure and convenient to produce, and the protective door device provided can effectively increase the security performance of the socket.

The reference signs shown in the figures are as follows: 1—housing, 2 —power switch, 3—USB jack, 4—three-prong outlet module, 41—outlet, 5—power line, 6—circuit board, 61—USB plugging terminal, 7—support frame assembly, 71—first support block, 72—second support block, 73—third support block, 74—fourth support block, 8—protective door device, 81—fixed cover, 811—through hole, 812—through slot, 813—first limiting projection, 814—second limiting protrusion, 815—fixed block, 816—first mounting post, 82—movable door, 821—bevel section, 822—projecting post, 23—second mounting post, 83—spring, 9—overload protector, 10—live-line conductive terminal, 11—null-line conductive terminal, 12—grounding conductive terminal, 13—live-line conductive strip, 14—null-line conductive strip, 15—grounding conductive strip.

DETAILED DESCRIPTION OF THE INVENTION

To facilitate the understanding of those skilled in the art, the invention will be further described below in conjunction with the accompanying drawings.

Figure 1:
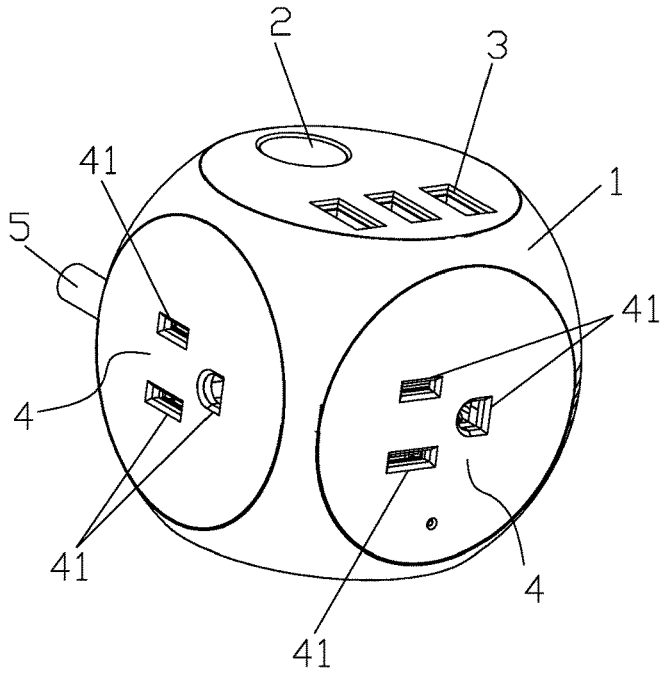
FIG. 1 is a schematic view of a structure of the invention.
Figure 2:
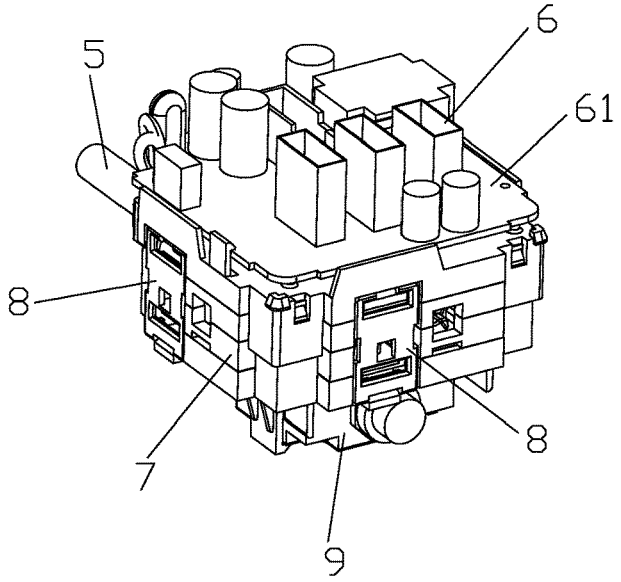
FIG. 2 is a schematic view of an internal structure of the invention.
Figure 3:
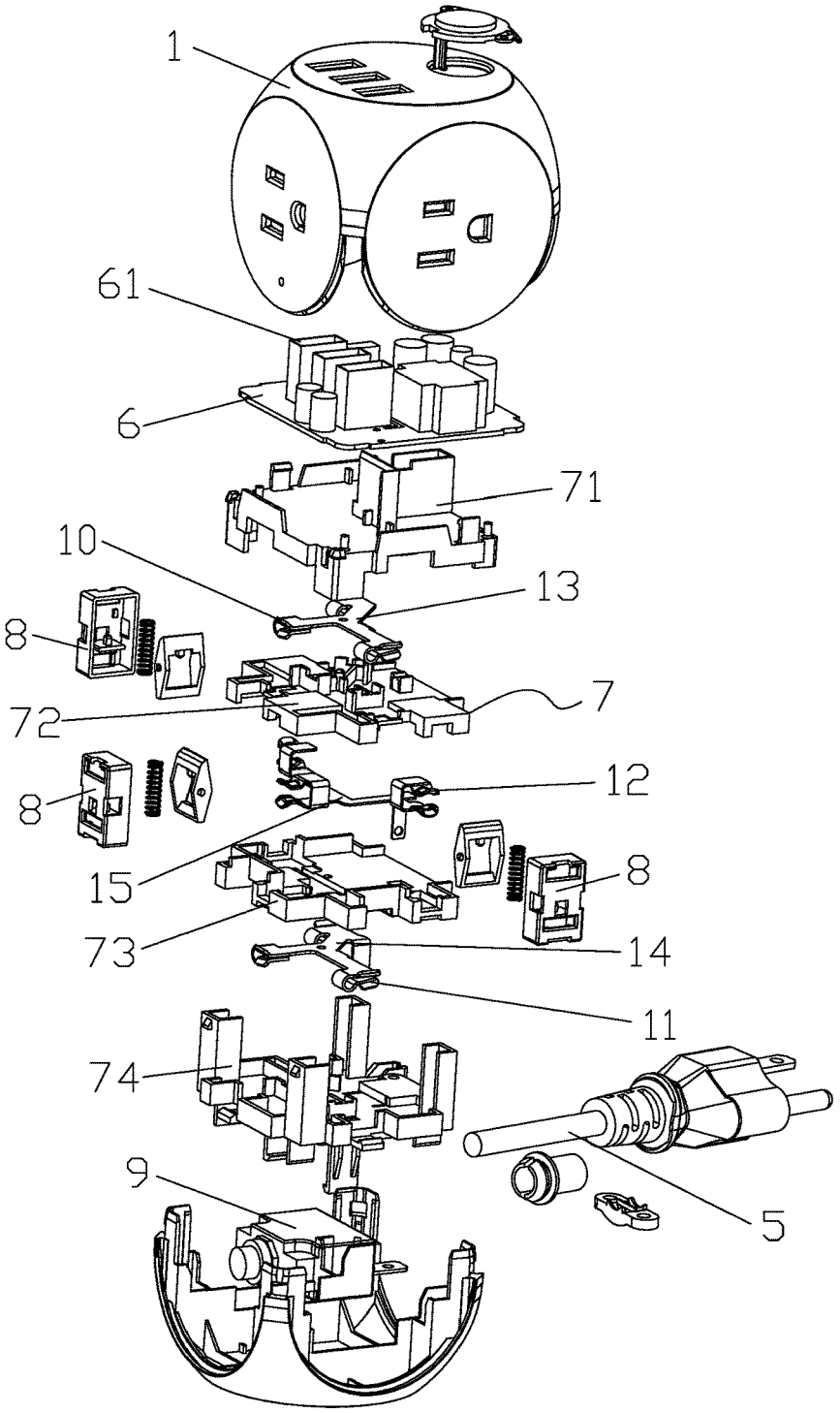
FIG. 3 is a schematic view of a breakdown structure of components and parts of the invention.

As shown in FIGS. 1, 2 and 3, an all-in-one stereo socket comprises a housing 1; the housing 1 is in the shape of a cube provided with six faces, with adjacent faces transitioned spherically; the housing 1 has a top face provided with a power switch 2 and a USB jack 3, three continuous side faces provided with three-prong outlet modules 4 each having an outlet 41, another side face provided with a power line 5, and a bottom face acting as a support face. A plug can be plugged conveniently via respective faces of the housing, achieving convenience in use. The USB jack 3 can also be used to charge mobile phones, tablets and other apparatuses directly.

The housing 1 is internally provided with a circuit board 6 and a support frame assembly 7; the circuit board 6 is provided with a USB plugging terminal 61 corresponding to the USB jack 3. The support frame assembly 7 is internally provided with live-line conductive terminals 10, null-line conductive terminals 11 and grounding conductive terminals 12, which are arranged corresponding to respective outlets 41; and the back face of each three-prong outlet module 4 is provided with a protective door device 8 fixed to the support frame assembly 7. The plug is inserted into each of the three-prong outlet modules 4 to connect the live-line conductive terminal 10, null-line conductive terminal 11 and grounding conductive terminal 12 for power-up. The protective door device 8 can play a protective role to prevent debris entry and accidental contact. The housing 1 is internally provided with an overload protector 9 connected with the power line 5 to prevent electric overload and avoid burning down the socket.

Figure 4:
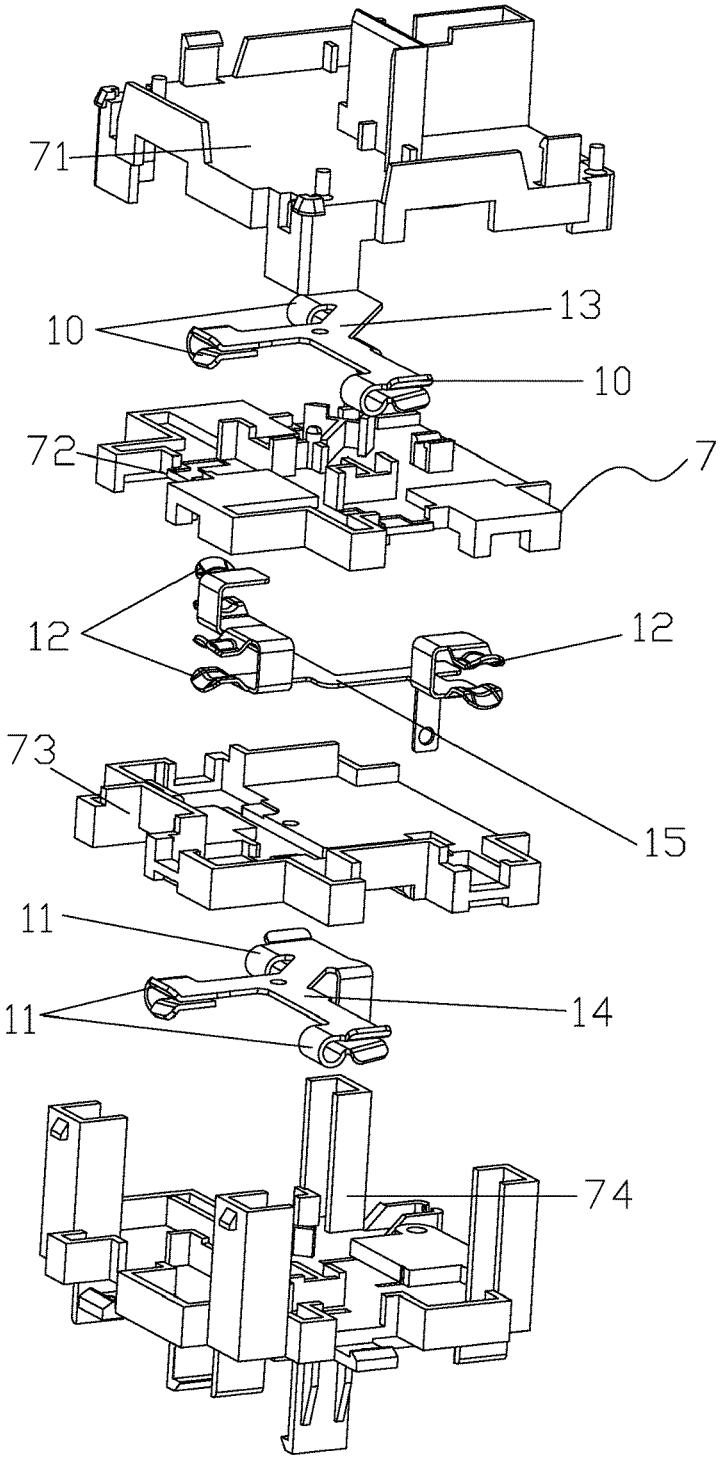
FIG. 4 is a schematic view of a breakdown structure of parts in a support frame assembly in the invention.

As shown in FIG. 4, the support frame assembly 7 is internally provided with live-line conductive strips 13, null-line conductive strips 14 and grounding conductive strips 15; the respective live-line conductive terminals 10 and live-line conductive strips 13 are in an all-in-one structure; the respective null-line conductive terminals 11 and null-line conductive strips 14 are in an all-in-one structure; and the respective grounding conductive terminals 12 and grounding conductive strips 15 are in an all-in-one structure. The all-in-one structure can be obtained directly by stamping, and thus is convenient to manufacture.

The support frame assembly 7 comprises a first support block 71, a second support block 72, a third support block 73 and a fourth support block 74, which are arranged from top to bottom in turn; the first support block 71 and the fourth support block 74 are fixed in a buckling way; and the second support block 72 and the third support block 73 are clamped and fixed between the first support block 71 and the fourth support block 74. This structure is simple and fast to assemble, thereby facilitating the increase in production efficiency.

The live-line conductive strips 13 are fixed between the first support block 71 and the second support block 72; the null-line conductive strips 14 are fixed between the third support block 73 and the fourth support block 74; and the grounding conductive strips 15 are fixed between the second support block 72 and the third support block 73. This structure is secure and reliable, guaranteeing the electrical reliability during the insertion of a plug.

Figure 5:
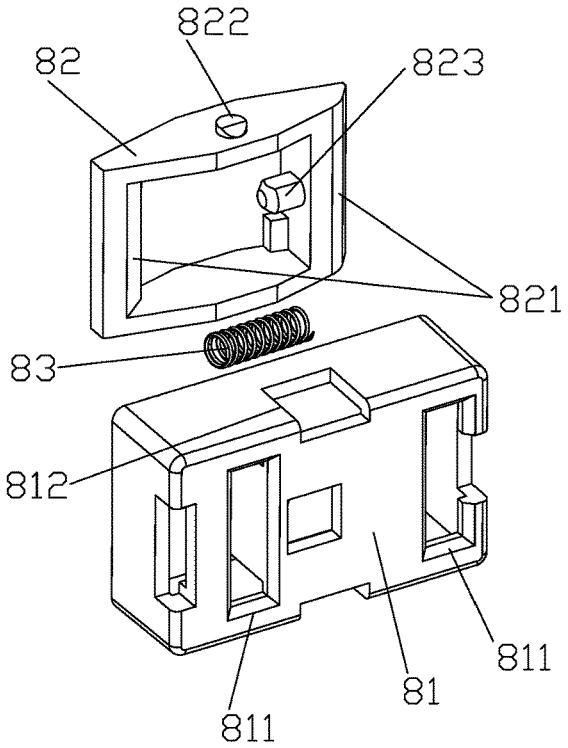
FIG. 5 is a schematic view of a breakdown structure of components and parts of a protective door device in the invention.
Figure 6:
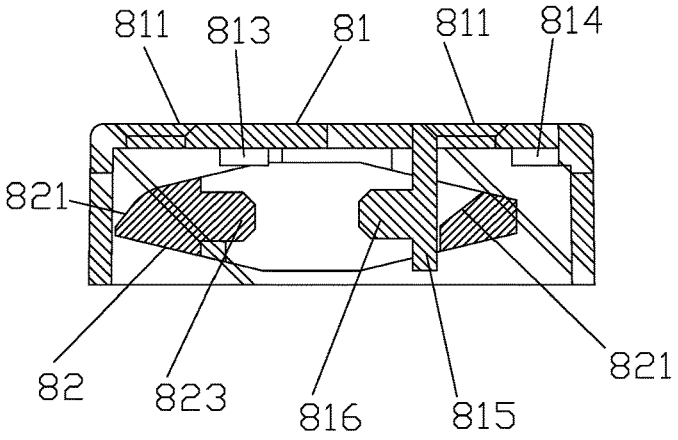
FIG. 6 is a schematic view of a sectional structure of the protective door device in the present invention.

As shown in FIGS. 5 and 6, the protective door device 8 comprises a fixed cover 81, which is provided with through holes 811 corresponding to the live-line conductive terminals 10 and the null-line conductive terminals 11 respectively; the fixed cover 81 is internally provided with a movable door 82, which is in the shape of a framework with two ends provided with bevel sections 821 arranged corresponding to the through holes 811; a spring 83 is disposed between the movable door 82 and the fixed cover 81 to press against the movable door 82 to close the through holes 811; two sides of the fixed cover 81 are provided with elongated through slots 812 respectively; the movable door 82 is provided with projecting posts 822, which correspond to the through slots 812 and are snapped into the through slots 812; and the projecting posts 822 can either slide along or rotate inside the through slots 812. The fixed cover 81 is internally provided with a first limiting projection 813 and a second limiting projection 814 for limiting the horizontal sliding of the movable door 82 after the movable door 82 is rotated; and the first limiting projection 813 abuts against the inner edge of the framework of the movable door 82 when the movable door 82 rotates towards one direction, and the second limiting projection 814 abuts against one end face of the movable door 82 when the movable door 82 rotates towards the other direction. The fixed cover 81 is internally provided with a fixed block 815, on which a first mounting post 816 is disposed, the movable door 82 is provided with a second mounting post 813, and two ends of the spring 83 are fixed to the first and second mounting posts 816 and 823 respectively. This structure facilitates the mounting of the spring 83 and makes the spring force acting on the movable door 82 more balanced.

When two plug pins are simultaneously inserted into the two through holes 811, the two plug pins simultaneously press against the two bevel sections 821, two ends of the movable door 82 are stressed in balance and horizontally slide under the press of the plug pins, thereby opening the through holes 811 to allow the two plug pins to be inserted for connecting the live-line conductive terminal 10 and the null-line conductive terminal 11 respectively; and when an object is inserted into one through hole 811, one of the bevel sections 821 is stressed, two ends of the movable door 82 are not stressed in balance so that the movable door 82 rotates around the projecting posts 822, the first limiting projection 813 or the second limiting projection 814 stops the horizontal sliding of the movable door 82 so that the through hole 811 cannot be opened, and a foreign object cannot be inserted into the socket, playing a role in security protection.

The above embodiments are preferred implementations of the invention, and direct or equivalent substitutions made only to the invention without departing from the concept of the invention shall fall within the protection scope of the invention.

What is claimed is:

1. An all-in-one stereo socket, comprising a housing, characterized in that the housing is in the shape of a cube provided with six faces, with adjacent faces transitioned spherically; the housing has a top face provided with a power switch and a USB jack, three continuous side faces provided with three-prong outlet modules each having an outlet, another side face provided with a power line, and a bottom face acting as a support face; the housing is internally provided with a circuit board and a support frame assembly; the circuit board is provided with a USB plugging terminal corresponding to the USB jack; the support frame assembly is internally provided with live-line conductive terminals, null-line conductive terminals and grounding conductive terminals, which are arranged corresponding to respective outlets; and the back face of each three-prong outlet module is provided with a protective door device fixed to the support frame assembly; the support frame assembly is internally provided with live-line conductive strips, null-line conductive strips and grounding conductive strips; the respective live-line conductive terminals and live-line conductive strips are in an all-in-one structure; the respective null-line conductive terminals and null-line conductive strips are in an all-in-one structure; and the respective grounding conductive terminals and grounding conductive strips are in an all-in-one structure; the support frame assembly comprises a first support block, a second support block, a third support block and a fourth support block, which are arranged from top to bottom in turn; the first support block and the fourth support block are fixed in a buckling way; and the second support block and the third support block are clamped and fixed between the first support block and the fourth support block; the live-line conductive strips are fixed between the first support block and the second support block; the null-line conductive strips are fixed between the third support block and the fourth support block; and the grounding conductive strips are fixed between the second support block and the third support block;

the protective door device comprises a fixed cover, which is provided with through holes corresponding to the live-line conductive terminals and the null-line conductive terminals respectively; the fixed cover is internally provided with a movable door, which is in the shape of a framework with two ends provided with bevel sections arranged corresponding to the through holes; a spring is disposed between the movable door and the fixed cover to press against the movable door to close the through holes; two sides of the fixed cover are provided with elongated through slots respectively; and the movable door is provided with projecting posts, which correspond to the through slots and are snapped into the through slots;

the fixed cover is internally provided with a first limiting projection and a second limiting projection for limiting the horizontal sliding of the movable door after the movable door is rotated; and the first limiting projection abuts against the inner edge of the framework of the movable door when the movable door rotates towards one direction, and the second limiting projection abuts against one end face of the movable door when the movable door rotates towards the other direction;

the fixed cover is internally provided with a fixed block, on which a first mounting post is disposed, the movable door is provided with a second mounting post, and two ends of the spring are fixed to the first and second mounting posts respectively.

2. The all-in-one stereo socket according to claim 1, characterized in that the housing is internally provided with an overload protector connected with the power line.

* * * * *